US010136701B2

(12) United States Patent
Klein et al.

(10) Patent No.: US 10,136,701 B2
(45) Date of Patent: Nov. 27, 2018

(54) TENSILE-STRAND ENCLOSURE SYSTEM FOR FOOTWEAR

(71) Applicant: NIKE, Inc., Beaverton, OR (US)

(72) Inventors: Ross Klein, Portland, OR (US); Nathan G. Schultze, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 15/297,910

(22) Filed: Oct. 19, 2016

(65) Prior Publication Data

US 2017/0105486 A1 Apr. 20, 2017

Related U.S. Application Data

(60) Provisional application No. 62/243,479, filed on Oct. 19, 2015.

(51) Int. Cl.

| | |
|---|---|
| ***A43C 1/04*** | (2006.01) |
| ***A43B 3/12*** | (2006.01) |
| ***A43B 5/06*** | (2006.01) |
| ***A43B 23/02*** | (2006.01) |
| ***A43C 5/00*** | (2006.01) |
| ***A43C 1/06*** | (2006.01) |

(52) U.S. Cl.

CPC ..... *A43C 1/04* (2013.01); *A43B 3/126* (2013.01); *A43B 5/06* (2013.01); *A43B 23/021* (2013.01); *A43B 23/025* (2013.01); *A43B 23/026* (2013.01); *A43B 23/0215* (2013.01); *A43C 1/06* (2013.01); *A43C 5/00* (2013.01)

(58) Field of Classification Search

CPC ..... A43C 1/04; A43C 1/00; A43B 23/021; A43B 23/025; A43B 23/0215; A43B 23/026

USPC ..... 36/50.1

See application file for complete search history.

(56) References Cited

U.S. PATENT DOCUMENTS

| | | | | |
|---|---|---|---|---|
| 1,668,120 | A * | 5/1928 | McLaren | A43C 11/004 36/50.1 |
| 5,345,697 | A | 9/1994 | Quellais | |
| 5,463,822 | A | 11/1995 | Miller et al. | |
| 5,469,640 | A | 11/1995 | Nichols et al. | |
| 5,511,325 | A | 4/1996 | Hieblinger et al. | |
| D376,042 | S | 12/1996 | Cooper | |
| D385,043 | S | 10/1997 | Worthington | |
| 6,052,921 | A | 4/2000 | Oreck et al. | |

(Continued)

FOREIGN PATENT DOCUMENTS

| | | |
|---|---|---|
| EP | 1769693 A1 | 4/2007 |
| EP | 2826390 A1 | 1/2015 |

(Continued)

OTHER PUBLICATIONS

"Salewa Men's MS Speed Ascent GTX Hiking Shoe," salewa.us, Sep. 12, 2015 https://web.archive.org/web/20150912150544/http://www.salewa.us/en/men-speed-ascentshoes.html.

(Continued)

*Primary Examiner* — Ted Kavanaugh

(74) *Attorney, Agent, or Firm* — Shook, Hardy & Bacon L.L.P.

(57) ABSTRACT

An arrangement of tensile strands is incorporated into a footwear article to provide at least part of an enclosure. The tensile strands may be adjustable to affect a size of the enclosure and an amount of compression of the enclosure.

20 Claims, 13 Drawing Sheets

(56) References Cited

U.S. PATENT DOCUMENTS

| | | | | |
|---|---|---|---|---|
| 6,128,835 | A | 10/2000 | Ritter et al. | |
| 6,286,233 | B1 | 9/2001 | Gaither | |
| D462,163 | S | 9/2002 | Zebe, Jr. | |
| 6,505,424 | B2 | 1/2003 | Oorei et al. | |
| 6,757,991 | B2 | 7/2004 | Sussmann | |
| D528,270 | S | 9/2006 | Keen | |
| 7,343,701 | B2 | 3/2008 | Pare et al. | |
| 7,562,470 | B2 | 7/2009 | Keen | |
| D614,855 | S | 5/2010 | Inohara et al. | |
| 7,841,106 | B2 | 11/2010 | Farys | |
| D694,513 | S | 12/2013 | Fogg | |
| 8,656,606 | B2 | 2/2014 | Hooper | |
| 8,813,395 | B2 | 8/2014 | Beers et al. | |
| 8,893,405 | B2 | 11/2014 | Dojan et al. | |
| 8,898,931 | B2 | 12/2014 | Gerber | |
| D737,042 | S * | 8/2015 | Thornhill | D2/973 |
| D737,561 | S | 9/2015 | Aveni et al. | |
| 9,125,455 | B2 | 9/2015 | Kerns et al. | |
| 9,375,052 | B2 | 6/2016 | Krueger | |
| 2004/0181972 | A1 * | 9/2004 | Csorba | A43B 7/1495 36/50.1 |
| 2006/0000116 | A1 | 1/2006 | Brewer | |
| 2012/0117821 | A1 | 5/2012 | Adams et al. | |
| 2014/0130372 | A1 * | 5/2014 | Aveni | A43B 3/122 36/83 |
| 2014/0196316 | A1 * | 7/2014 | Follet | A43B 23/0245 36/84 |
| 2014/0223779 | A1 * | 8/2014 | Elder | A43C 1/04 36/103 |

FOREIGN PATENT DOCUMENTS

| | | | |
|---|---|---|---|
| WO | 9410869 | A1 | 5/1994 |
| WO | 2005102091 | A1 | 11/2005 |
| WO | 2014085205 | A1 | 6/2014 |
| WO | 2015014374 | A1 | 2/2015 |

OTHER PUBLICATIONS

"Teva Wraptor Breathe Hiking Shoes," Amazon, amazon.com, Model #B001AOCJP4, accessed: Sep. 2015. http://www.amazon.com/Teva-Womens-Wraptor-Breathe-American/dp/B001AOCJP4/ref=cm_cr_pr_product_top?ie=UTF8.

"La Sportiva Mutant Running Shoe," LA Sportiva, sportiva.com, Wayback Machine, web.archive.org, Nov. 9, 2014. https://web.archive.org/web/20141109041920/http://www.sportiva.com/products/footwear/mountain-running/mutant?#tech-specs.

"Keen Uneek Sandal," Keen, keenfootwear.com, Wayback Machine, web.archive.org, Jul. 21, 2014. https://web.archive.org/web/20140721012917/http://www.keenfootwear.com/us/en/uneek.

"NIKE air zoom pegasus," Nike, Nike.com, Model # 749340-400, May 29, 2015 http://www.nike.com/us/en_us/launch/c/2015-05/nike-air-zoom-pegasus-32.

International Search Report and Written Opinion dated Jan. 20, 2017 in International Patent Application No. PCT/US2016/057691, 14 pages.

* cited by examiner

TENSILE-STRAND ENCLOSURE SYSTEM FOR FOOTWEAR

CROSS-REFERENCE TO RELATED APPLICATIONS

This application claims priority to U.S. Provisional Application No. 62/243,479 (filed Oct. 19, 2015), which is incorporated herein by reference in its entirety.

BRIEF SUMMARY

Aspects of the present technology are related to an arrangement of tensile strands that are incorporated into a footwear article to provide at least part of an enclosure for the footwear article. In another aspect, the tensile strands may be adjustable to affect a size of the enclosure and an amount of compression of the enclosure. Aspects of the technology are defined by the claims below, not this Brief Summary. A high-level overview of various aspects of the technology is provided in this section to introduce a selection of concepts that are further described below in the detailed description. This Brief Summary is not intended to identify key features or essential features of the claimed subject matter, nor is it intended to be used as an aid in isolation to determine the scope of the claimed subject matter.

BRIEF DESCRIPTION OF THE DRAWINGS

The present invention is described in detail herein with reference to the attached drawing figures, which are incorporated herein, wherein.

DETAILED DESCRIPTION

Subject matter is described throughout this Specification in detail and with specificity in order to meet statutory requirements. But the aspects described throughout this Specification are intended to be illustrative rather than restrictive, and the description itself is not intended necessarily to limit the scope of the claims. Rather, the claimed subject matter might be practiced in other ways to include different elements or combinations of elements that are similar to the ones described in this Specification and that are in conjunction with other present, or future, technologies. Upon reading the present disclosure, alternative aspects may become apparent to ordinary skilled artisans that practice in areas relevant to the described aspects, without departing from the scope of this disclosure. It will be understood that certain features and subcombinations are of utility and may be employed without reference to other features and subcombinations. This is contemplated by and is within the scope of the claims.

Figure 1:
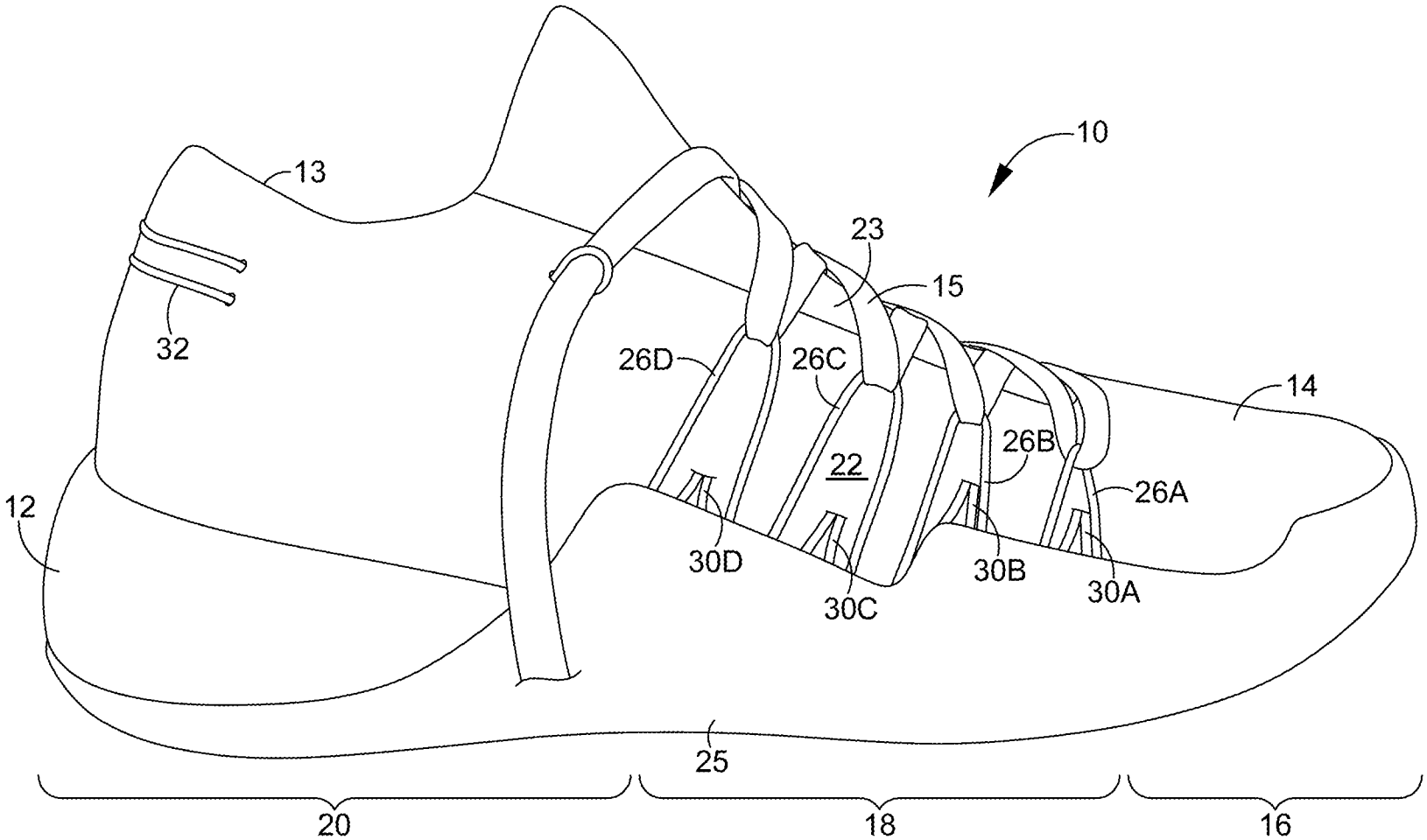
FIG. 1 depicts a lateral-side view of a footwear article in accordance with an aspect hereof.
Figure 2:
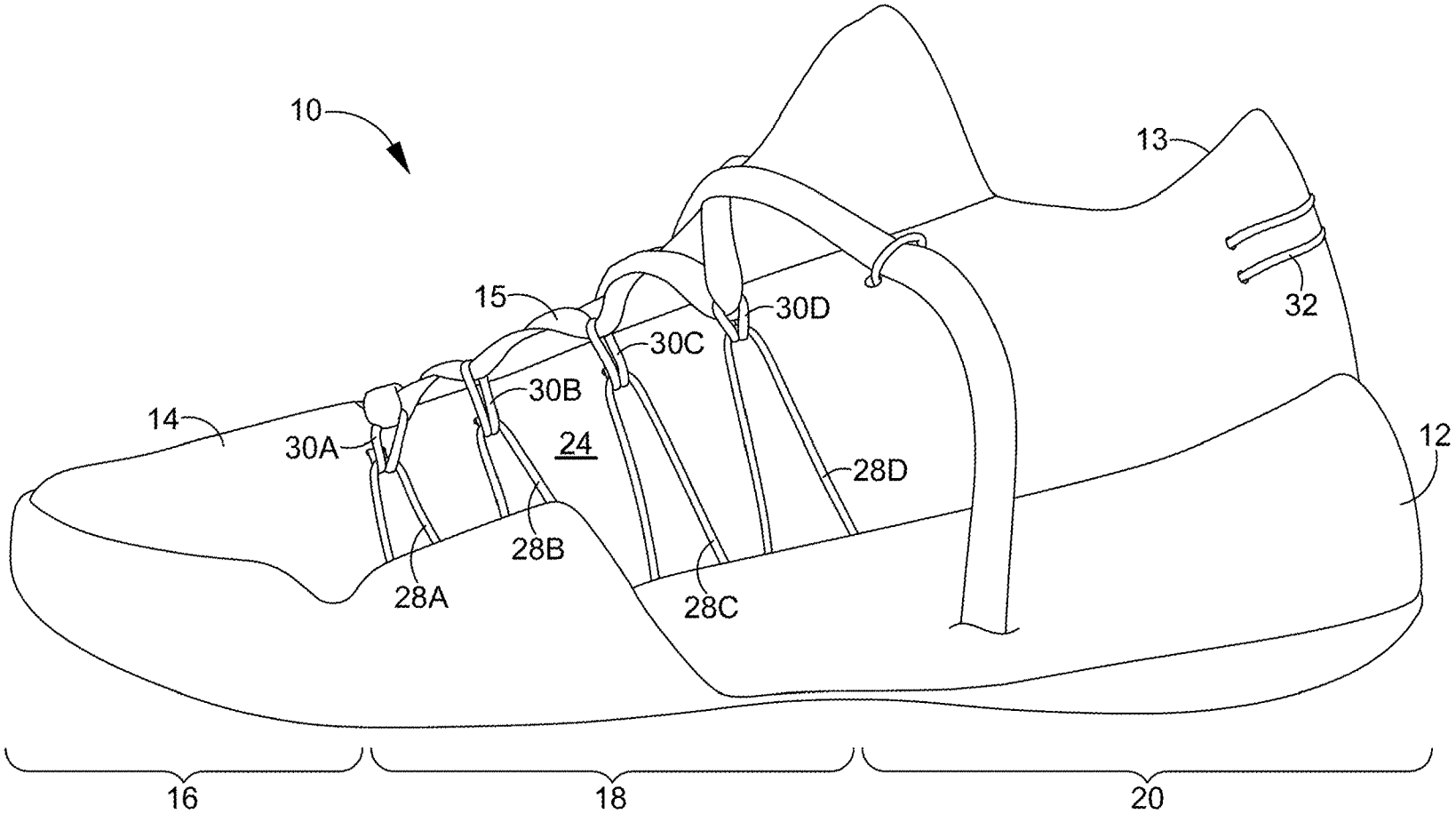
FIG. 2 depicts a medial-side view of the footwear article in FIG. 1 in accordance with an aspect hereof.

The subject matter described in this Specification generally relates to a footwear article including tensile-strand elements, and an exemplary depiction is provided by FIGS. 1 and 2. At a high level, tensile-strand elements (e.g., tensile strand 30A) are usable to adjust a fit of the footwear article 10, and further aspects will be described in more detail in other parts of this Specification. The illustrative figures depict, and the Specification describes, certain styles of footwear, such as footwear worn when engaging in athletic activities (e.g., basketball shoes, cross-training shoes, running shoes, and the like). But the subject matter described herein may be used in combination with other styles of footwear, such as dress shoes, loafers, boots, and the like.

In FIGS. 1 and 2, the footwear article 10 includes a sole structure 12 and an upper 14. The upper 14 and the sole 12 generally form a foot-receiving space that encloses at least part of a foot when the footwear is worn or donned. The foot-receiving space is accessible by inserting a foot through an opening formed by the ankle collar 13. When describing various aspects of the footwear 10, relative terms may be used to aid in understanding relative relationships. For instance, the footwear 10 may be divided into three general regions: a forefoot region 16, a midfoot region 18, and a heel region 20. The footwear 10 also includes a lateral side 22, a medial side 24, a superior portion 23, and an inferior portion 25. The forefoot region 16 generally includes portions of the footwear 10 corresponding with the toes and the joints connecting the metatarsals with the phalanges. The midfoot region 18 generally includes portions of footwear 10 corresponding with the arch area of the foot, and the heel region 20 corresponds with rear portions of the foot, including the calcaneus bone. The lateral side 22 and the medial side 24 extend through each of regions 16, 18, and 20 and correspond with opposite sides of footwear 10. More particularly, the lateral side 22 corresponds with an outside area of the foot (i.e., the surface that faces away from the other foot), and the medial side 24 corresponds with an inside area of the foot (i.e., the surface that faces toward the other foot). Further, the superior portion 23 and the inferior portion 25 also extend through each of the regions 16, 18, and 20. The superior portion 23 generally corresponds with a top portion that is oriented towards a person's head when the person's feet are positioned flat on the ground and the person is standing upright, whereas the inferior portion generally corresponds with a bottom portion oriented towards the bottom of a person's foot. The regions 16, 18, and 20 and the sides 22 and 24 and the portions 23 and 25 are not intended to demarcate precise areas of footwear 10. Rather, regions 16, 18, and 20 and sides 22 and 245 and the portions 23 and 25 are intended to represent general areas of footwear 10 to aid in understanding the various descriptions provided in this Specification. In addition, the regions, sides, and portions are provided for explanatory and illustrative purposes and are not meant to require a human being for interpretive purposes.

The upper 14 may be constructed of various materials, and in FIGS. 1 and 2, the upper 14 is constructed to include various tensile-strand elements. For example, in FIG. 1, tensile-strand elements 26A-D are arranged on a lateral side 22 of the footwear 10 and generally in the midfoot region 18. In addition, tensile-strand element 32 is positioned in the heel region 20 of the foot and extends from the lateral side to the medial side. As seen in FIG. 2, tensile-strand elements 28A-D are arranged on the medial side 24 of the footwear 10 and generally in the midfoot region 18. In addition, FIGS. 1 and 2 illustratively depict one aspect in which tensile-strand elements 30A-D extend from the lateral side 22 to the medial side 24. These tensile-strand elements are described in greater detail below.

The term "tensile strand" refers to an elongate member generally having a length that is substantially greater than a width and a thickness. Some types of tensile strands include at least a portion that is flexible and non-rigid. A tensile strand may include various constructions of various types of material and may have the configuration of various filaments, fibers, yarns, threads, ropes, cables, wires, or extrudates. For example, a tensile strand may include an intertwining of smaller filaments or fibers that are woven, knitted, braided, or otherwise intertwined together. A tensile strand may also include various types of materials, such as rayon, nylon, polyester, polyacrylic, silk, cotton, carbon, carbon, glass, aramids (e.g., para-aramid fibers and meta-aramid fibers), ultra high molecular weight polyethylene (UHMW-PE), liquid crystal polymer, copper, aluminum, and steel.

As will be described in other parts of the Specification, an aspect of the technology includes a system of tensile-strand elements that are coupled to a footwear article to provide an enclosure or to affect a fit of a footwear article.

Exemplary Tensile-Strand Arrangement

Figure 3:
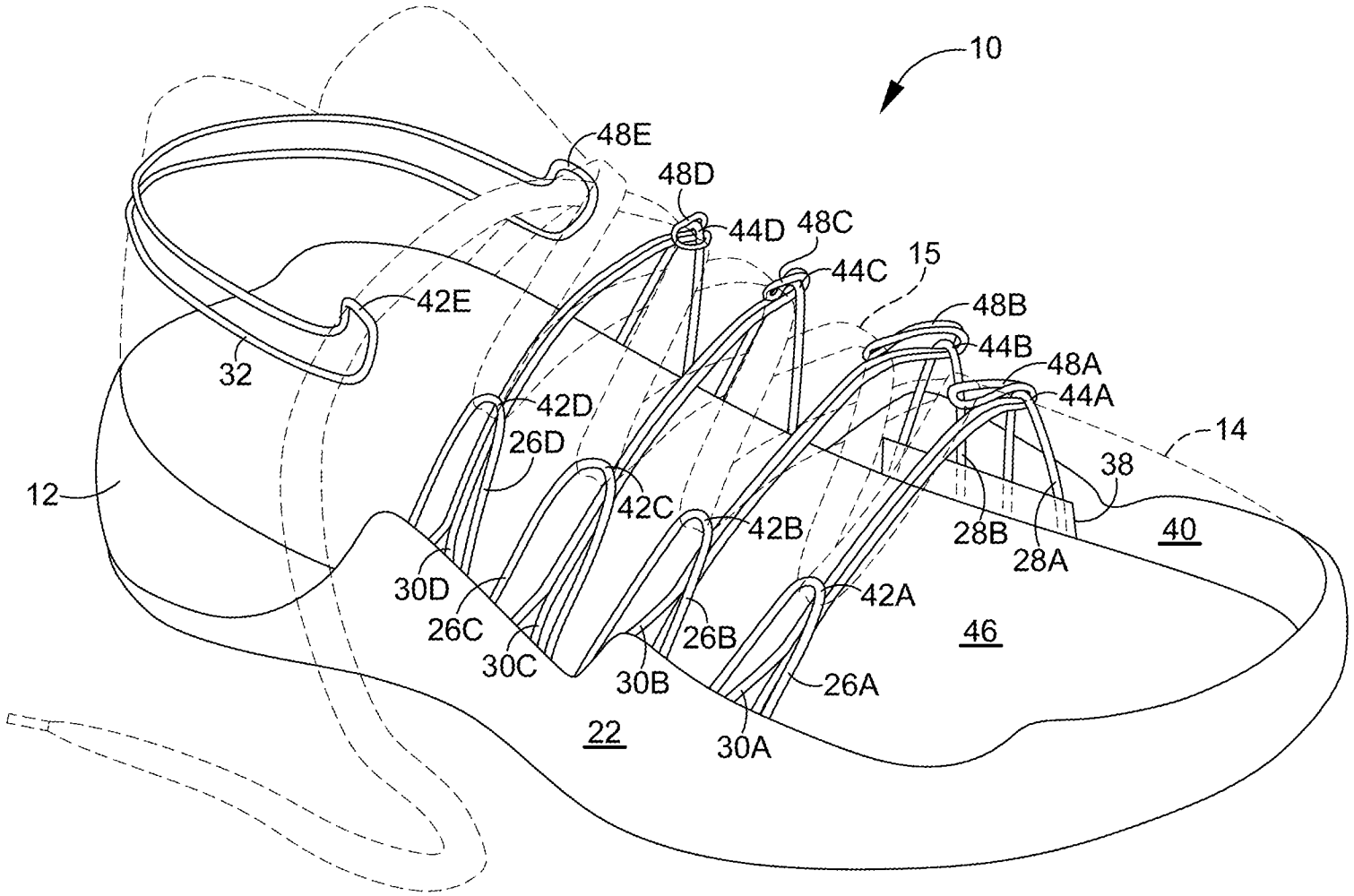
FIG. 3 depicts a front lateral perspective view of the footwear article in FIG. 1 with at least a portion of an upper in a ghosted view in accordance with an aspect hereof.
Figure 4:
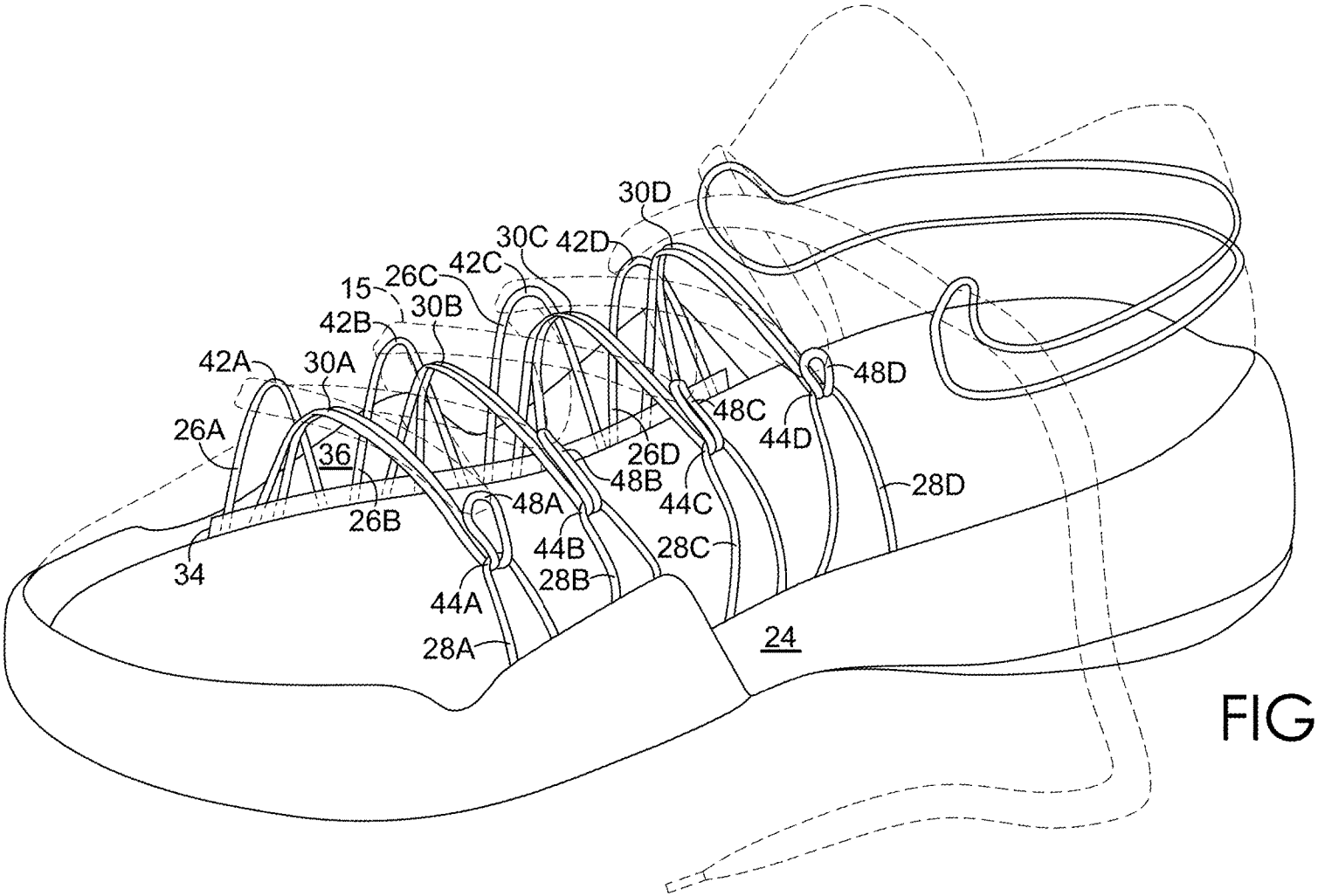
FIG. 4 depicts a front medial perspective view of the footwear article in FIG. 3 in accordance with an aspect hereof.

Referring now to FIGS. 3 and 4, an exemplary system of tensile strands is generally illustrated that provides a size-adjustable enclosure for the footwear 10. In FIGS. 3 and 4, the footwear 10 includes the sole 12, the upper 14, and a lace element 15. The upper 14 and the lace element 15 are illustrated in a ghosted view in order to more clearly depict portions of tensile strands, which may have otherwise been hidden from view, such as in FIGS. 1 and 2.

For explanatory purposes, the tensile strands may be categorized into groups or sets based on orientation, position, function, and the like. For example, a first set of tensile strands may include tensile strands 26A-D, each of which generally extends along the lateral side 22 of the midfoot region 18 and provides an anchor point (e.g., tethered anchor point) for the lace element 15. A second set of tensile strands may include tensile strands 28A-D, each of which generally extends along the medial side 24 of the midfoot region 18 and provides an anchor point (e.g., tethered anchor point) for the tensile strands 30A-D. A third set of tensile strands may include tensile strands 30A-D, each of which generally extends from the lateral side 22 over to the medial side 24 and in the midfoot region 18. Each of the tensile strands 30A-D also provides an anchor point for the lace element 15 and is usable to adjust a fit of the footwear 10. And a fourth set of tensile strands may include tensile strand 32, which also extends from the lateral side 22 over to the medial side 24 in the heel region 20 and provides anchor points for the lace element 15. The quantity of tensile strands illustrated in the various figures is only exemplary, and a set of tensile strands may include as few as a single tensile strand or may include more than four tensile strands.

The tensile strands may be coupled to the footwear 10 using various attachment techniques, such that the tensile strands might be coupled to the sole 12, to the upper 14, or to both the sole 12 and the upper 14. In FIGS. 3 and 4, an exemplary aspect is illustrated in which various tensile strands are coupled to the sole 12. For example, in FIG. 4 the tensile strands 26A-D and 30A-D are retained between a bonding strip 34 and an inward-facing surface 36 of the lateral side 22 of the sole 12. In other aspects, the tensile strands 26A-D and 30A-D may be bonded directly to the surface 36 using a bonding agent. In addition, one or more of the tensile strands 26A-D and 30A-D may be coupled between the upper 14 and the surface 36, such that the bonding strip 34 is omitted. In FIG. 3, at least some of the tensile strands 28A-D are retained between another bonding strip 38 and an inward-facing surface 40 of the medial side of the sole 12. As previously indicated, the tensile strands 28A-D may be bonded directly to the surface 40 using a bonding agent, and one or more of the tensile strands 28A-D may be coupled between the upper 14 and the surface 40, such that the bonding strip 38 is omitted.

Each of the tensile strands generally includes an elongated portion that extends from a respective attachment point at which the tensile strand attaches to the footwear 10. In addition, a tensile strand may include a loop portion that terminates the elongated portion and that is generally opposite to the attachment point. For example, each of the tensile strands 26A-D includes a respective loop portion 42A, 42B, 42C, and 42D, and as will be described in other parts of the Specification, the loop portions 42A-D function as anchor points (i.e., tethered anchor point) for a lace element 15 used to adjust a fit of the footwear 10. In addition, each of tensile strands 28A-D also includes a respective loop portion 44A, 44B, 44C, and 44D, which interloops with a respective one of the tensile strands 30A-D. That is, in an aspect of the present invention, each of the tensile strands 30A-D extends from a respective attachment point on the lateral side of the footwear 10 and passes through one of the loop portions 44A-D on the medial side of the footwear 10. For example, the tensile strand 30A extends from the lateral side of the footwear 10 and passes over to the medial side of the footwear 10, and on the medial side, the tensile strand 30A passes through the loop portion 44A of the tensile strand 28A. In a similar manner, each of tensile strands 30B-D passes through the loop portions 44B-D, respectively. In a further aspect, tensile strand 32 is coupled to the heel portion of the footwear, such as by interweaving with the upper 14. The tensile strand 32 also includes loops 42E and 48E that also function as anchor points for the lace element 15.

FIGS. 3 and 4 further illustrate that each of tensile strands 30A-D includes a loop portion 48A-D, respectively, which passes through a respective loop portion 44A-D of the tensile strands 28A-D. That is, the loop portion 48A of tensile strand 30A interloops with the loop portion 44A of the tensile strand 28A; the loop portion 48B of tensile strand 30B interloops with the loop portion 44B of the tensile strand 28B; the loop portion 48C of tensile strand 30C interloops with the loop portion 44C of the tensile strand 28C; and the loop portion 48D of tensile strand 30D interloops with the loop portion 44D of the tensile strand 28D. As such, each of tensile strands 30A-D is anchored to the medial side of the footwear 10 by interlooping with a respective loop portion 44A-D. In addition, each of the loop portions 48A-D that are interlooped with loop portions 44A-D form anchor points for receiving a portion of a lacing strand 15.

The various sets of tensile strands 26A-D, 28A-D, 30A-D, and 32 in FIGS. 3 and 4 collectively form at least a partial enclosure for the footwear 10 that is usable to retain a person's foot against the footbed 46. That is, the tensile strands 26A-D extend along the lateral side, the tensile strands 28A-D extend along the medial side, and the tensile strands 30A-D extend along the superior portion of the footwear from the lateral side to the medial side. In addition, the tensile strand 32 at least partially encloses the heel portion 20 of the footwear in the posterior portion of the foot-receiving space. As previously described, the tensile strands also provide anchor points (e.g., loops 42A-E and 48A-E) for the lace element 15. As such, the lace element 15 can be threaded through the anchor points and can be used to cinch or release one or more sets of the tensile-strand elements in order to adjust a fit of the footwear 10. For example, by pulling on both ends of the lace element 15, the loops 42A-E (i.e., lace anchor points) can be drawn towards the loops 48A-E (i.e., lace anchor points), which in effect pulls the tensile strands 26A-D, 30A-D, and 32 inward and towards the foot-receiving space and increases tension on the lateral, superior, and posterior portions of the footwear. Moreover, applying tension to the loops 48A-D (i.e., by the lace element 15) also pulls the tension strands 28A-D inward and increases tension on the medial side of the footwear 10. As such, it can be seen how the system of tensile strands 26A-D, 28A-D, 30A-D, and 32 collectively enclose various portions of the footwear and distribute tension around various sides of the footwear, including the posterior, medial, lateral, and superior portions.

FIGS. 3 and 4 depict one arrangement of tensile strands in accordance with one aspect of the technology. Alternative configurations and arrangements are possible without departing from the scope of this Specification, including the claims. For example, other arrangements of tensile strands might include fewer or more tensile strands than those depicted in FIGS. 3 and 4. An exemplary alternative configuration might include tensile strands 30B and 30C and omit tensile strands 30A and 30D, or vice-versa. Another alternative configuration might include tensile strands 30A and 30C and omit tensile strands 30B and 30D, or vice-versa. In addition, one or more tensile strands might attach to the footwear on the medial side (e.g., to the inward-facing surface 40) and extend from the medial side to the lateral side.

Figure 12:
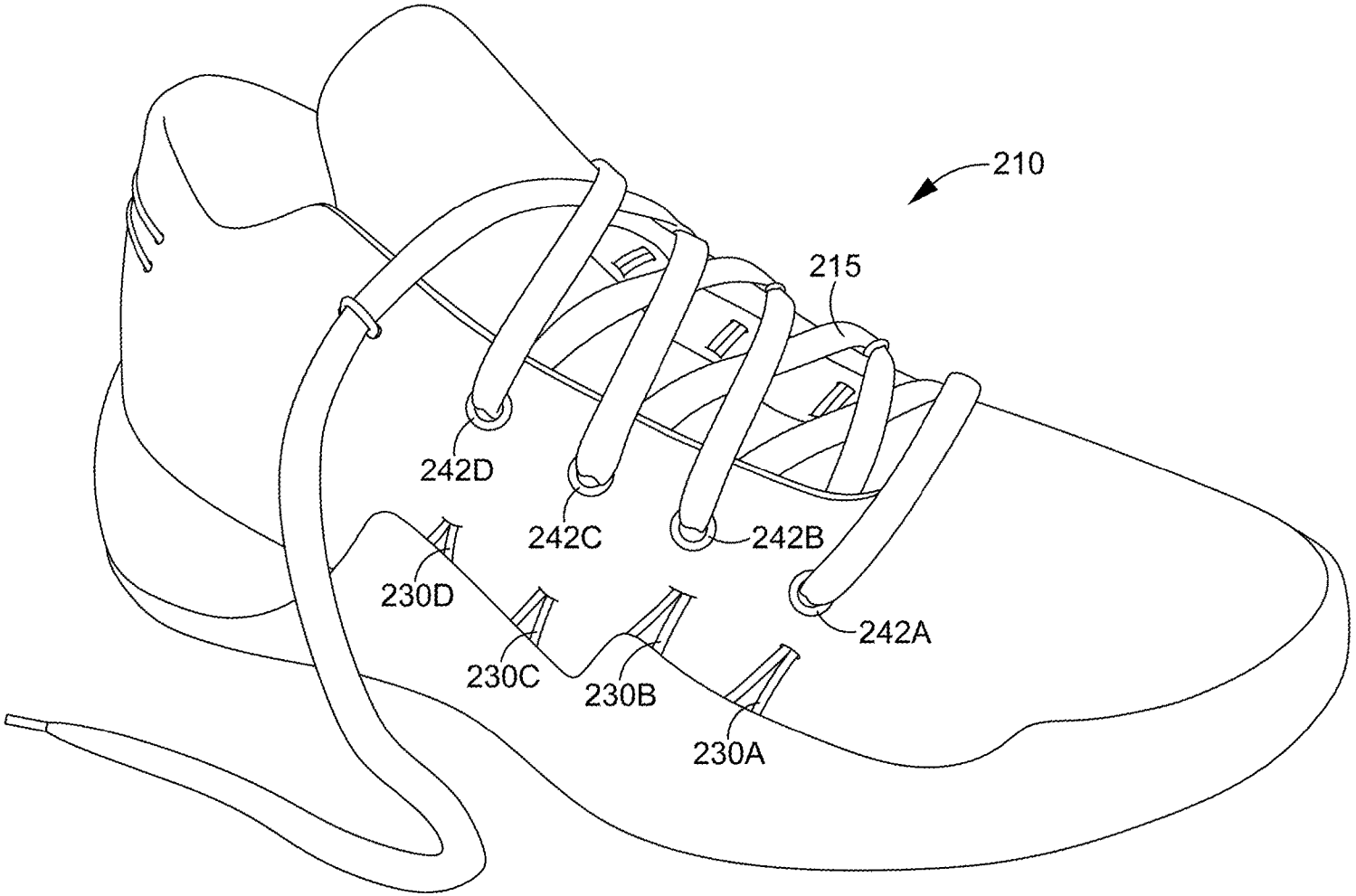
FIG. 12 depicts a front lateral view of another alternative footwear article in accordance with an aspect hereof.
Figure 13:
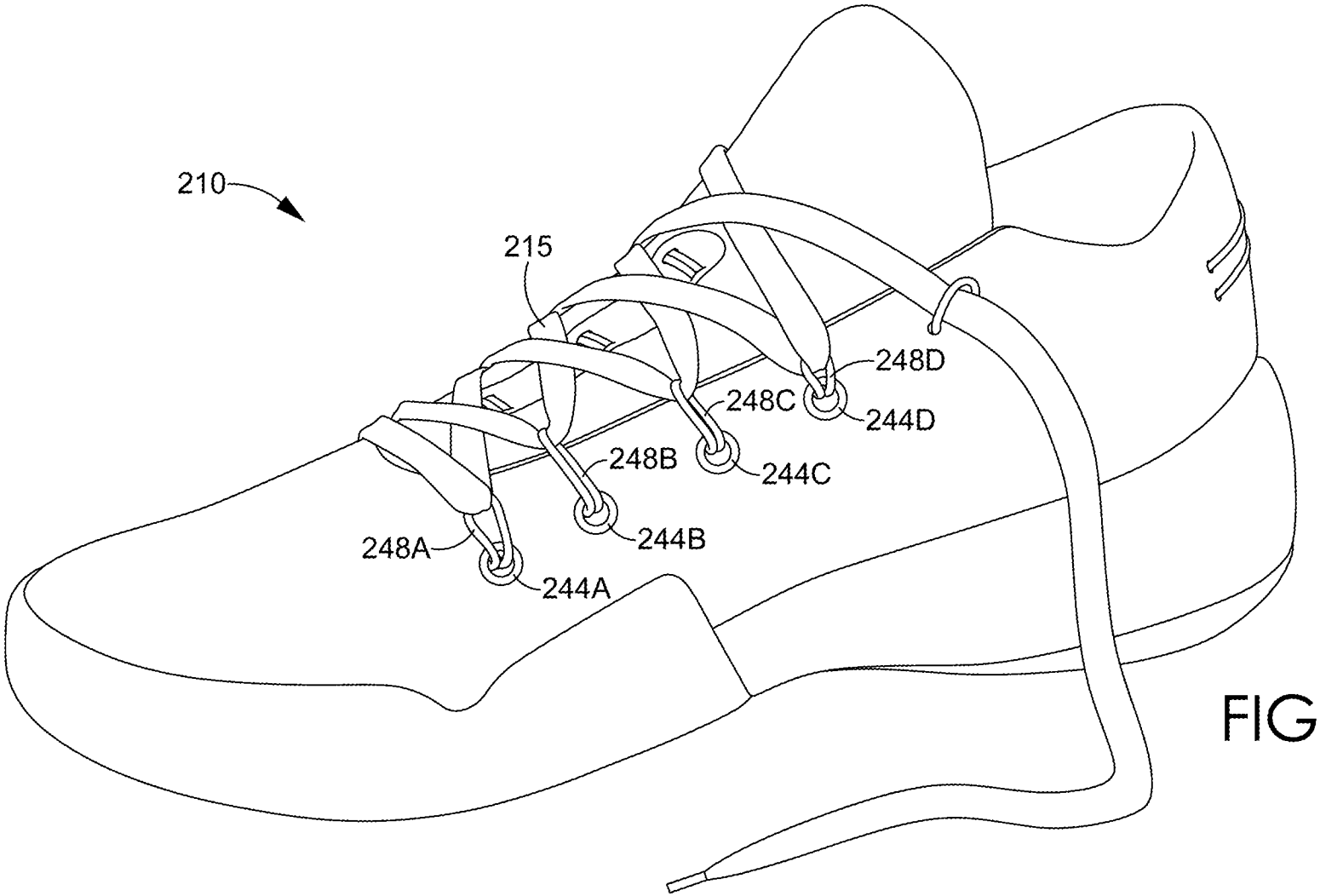
FIG. 13 depicts a front medial view of the footwear article in claim 12 in accordance with an aspect hereof.

The various sets of tensile strands depicted in FIGS. 3 and 4 may be integrated into a footwear article in various manners to achieve the partial enclosure and fit-adjusting features. For instance, as depicted in FIGS. 5-9 the tensile strands may be combined with an upper portion 14 to form a size-adjustable enclosure. In another exemplary aspect depicted by FIGS. 10 and 11, the tensile strands may form a size-adjustable footwear article 110 without being combined with an additional upper portion. Furthermore, the various sets of tensile strands depicted in FIGS. 3 and 4 are exemplary, and in other aspects, tensile strands may be added or deleted. For example, FIGS. 12 and 13 depict an exemplary footwear article 210 in which tensile strands 26A-D and 28A-D have been omitted, and shoelace eyelets have been constructed into the upper portion 114. These various other aspects are described in greater detail below.

Exemplary Upper with Tensile Strands

Figure 5:
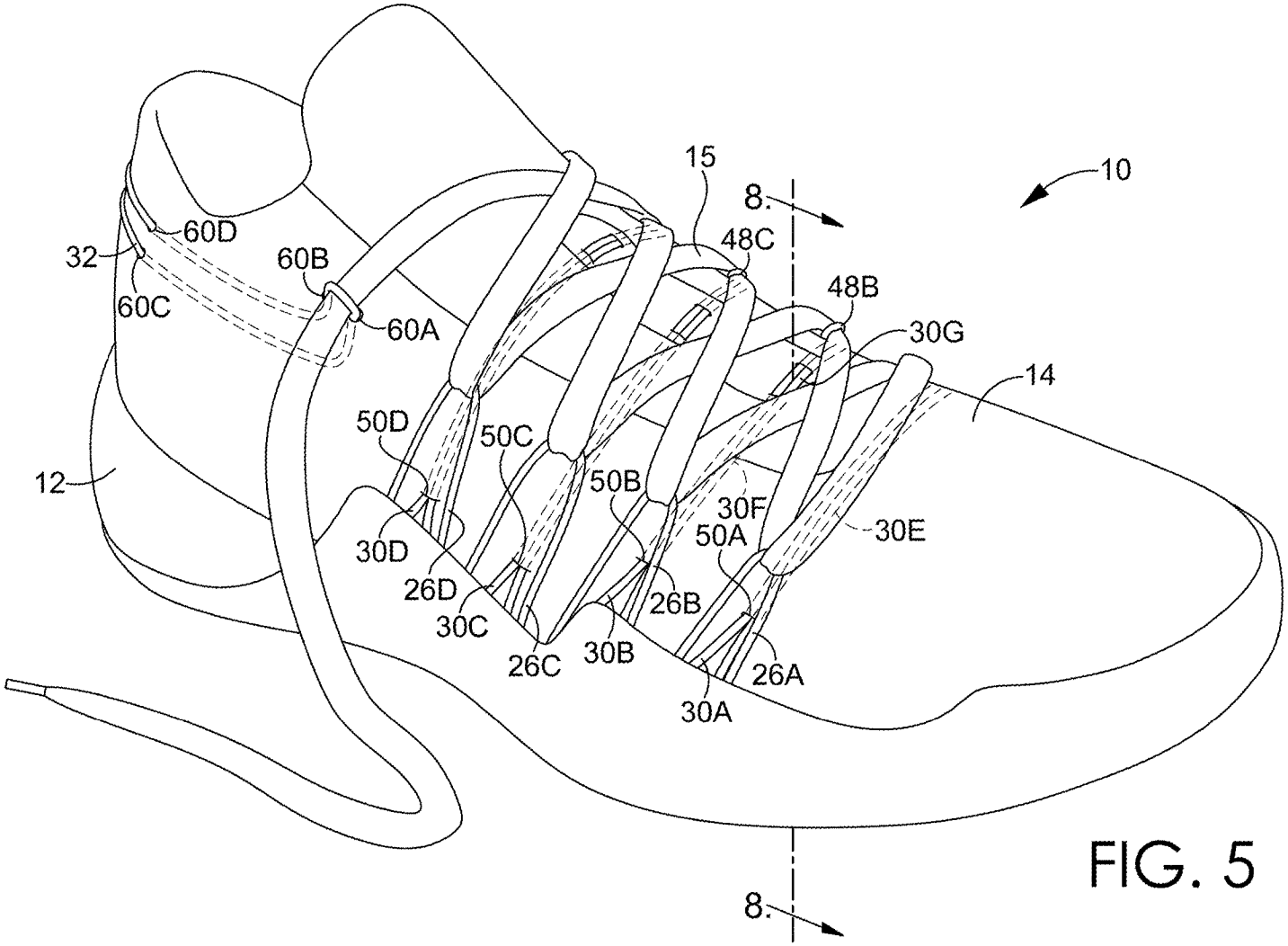
FIG. 5 depicts a front lateral perspective view of the footwear article in FIG. 1 in accordance with an aspect hereof.
Figure 6:
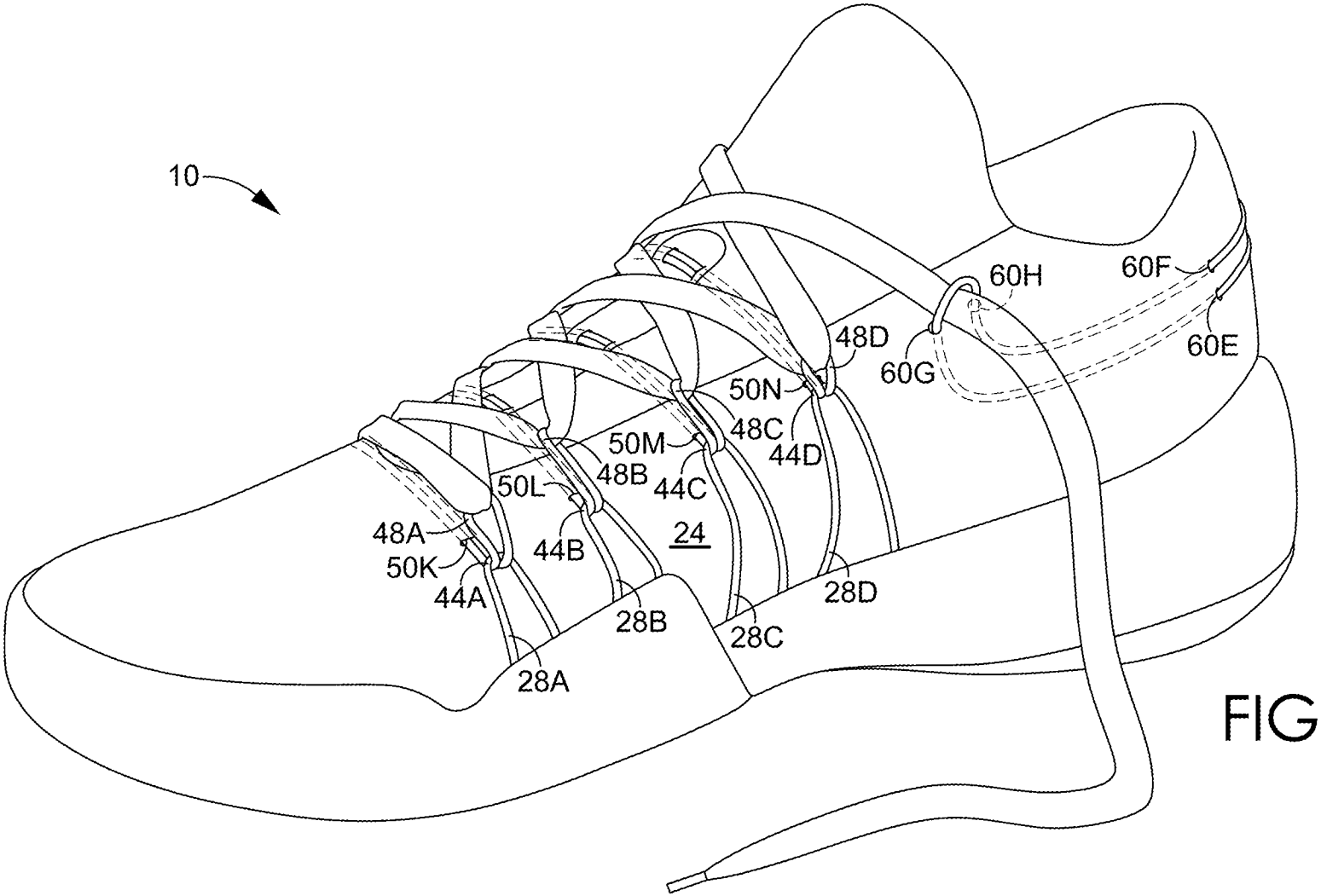
FIG. 6 depicts a front medial perspective view of the footwear article in FIG. 1 in accordance with an aspect hereof.
Figure 7:
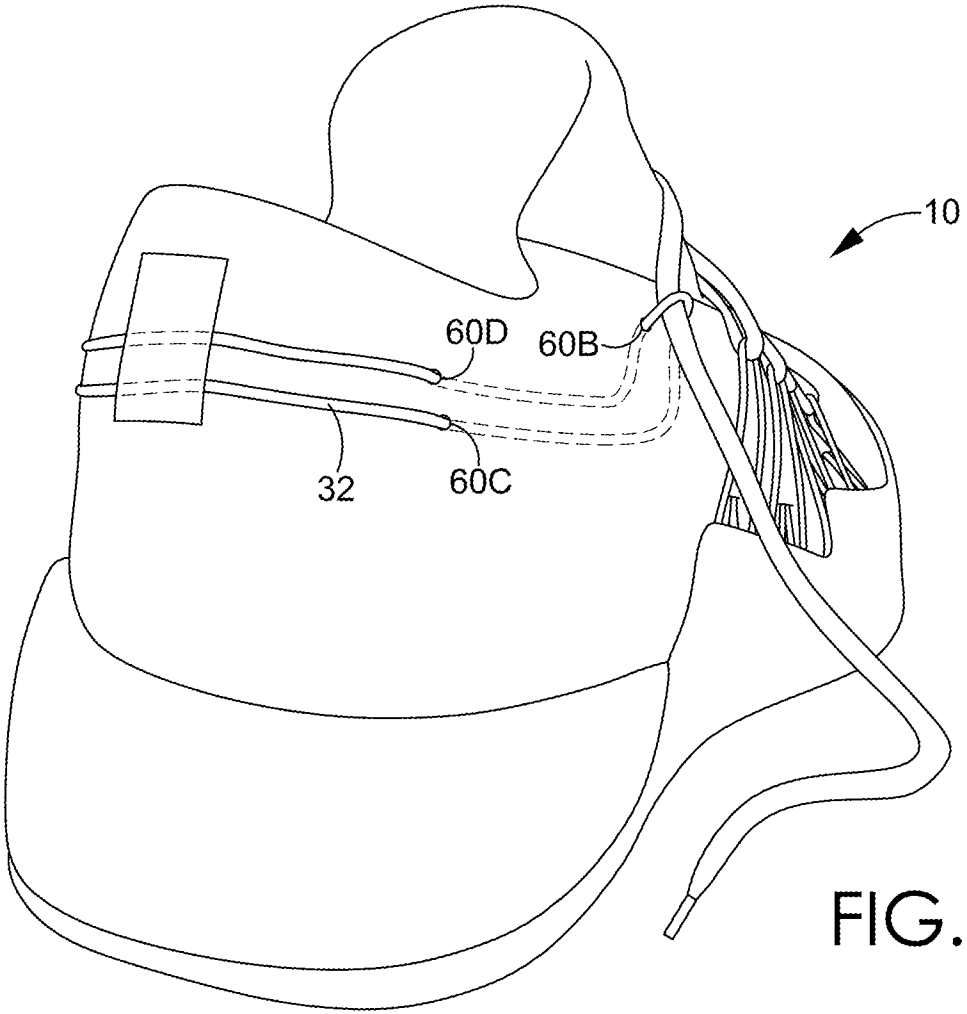
FIG. 7 depicts a rear lateral perspective view a front lateral perspective view of the footwear article in FIG. 1 in accordance with an aspect hereof.
Figure 8:
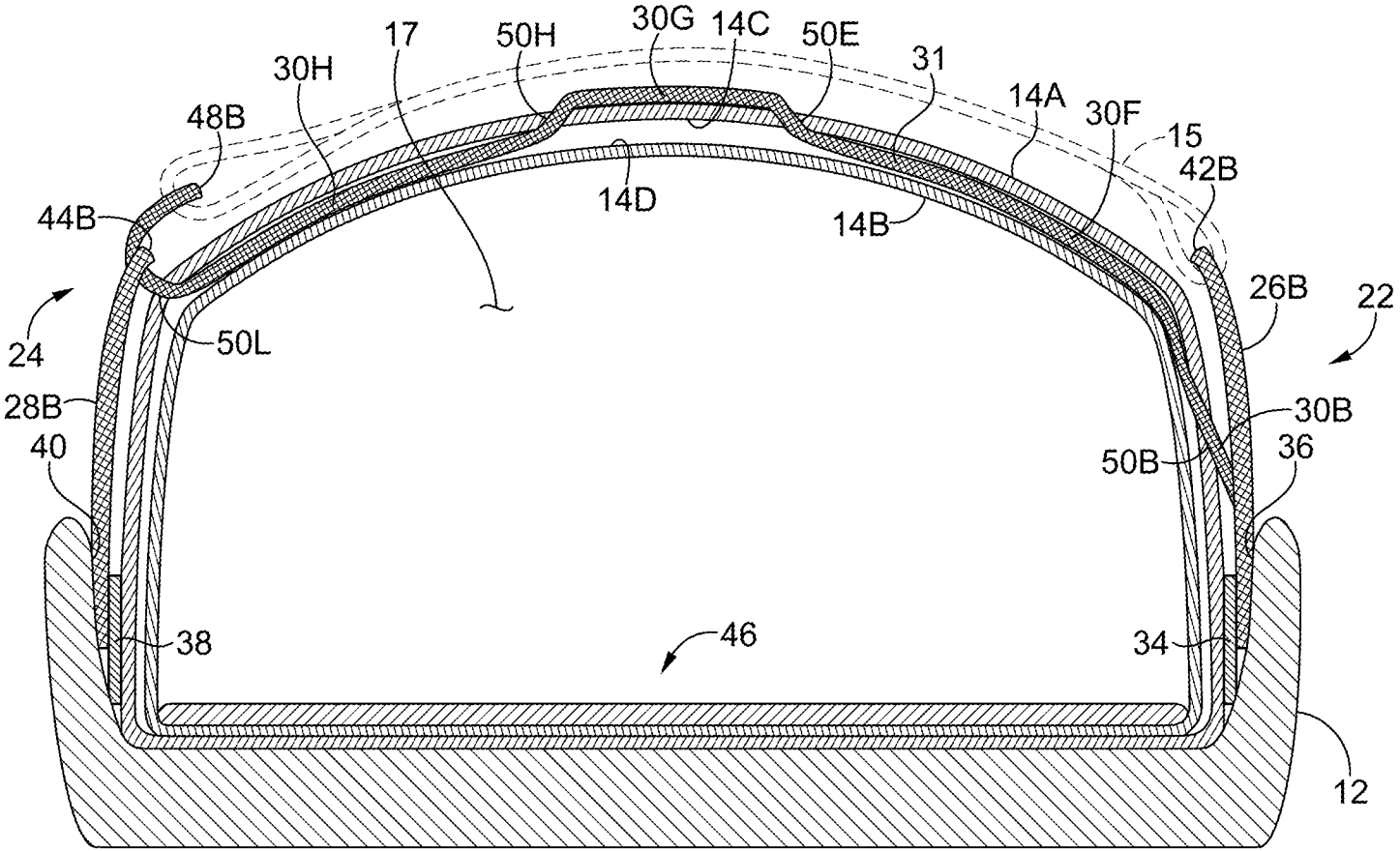
FIG. 8 depicts a cross-sectional view taken from the cut line 8-8 in FIG. 5 in accordance with an aspect hereof.
Figure 9:
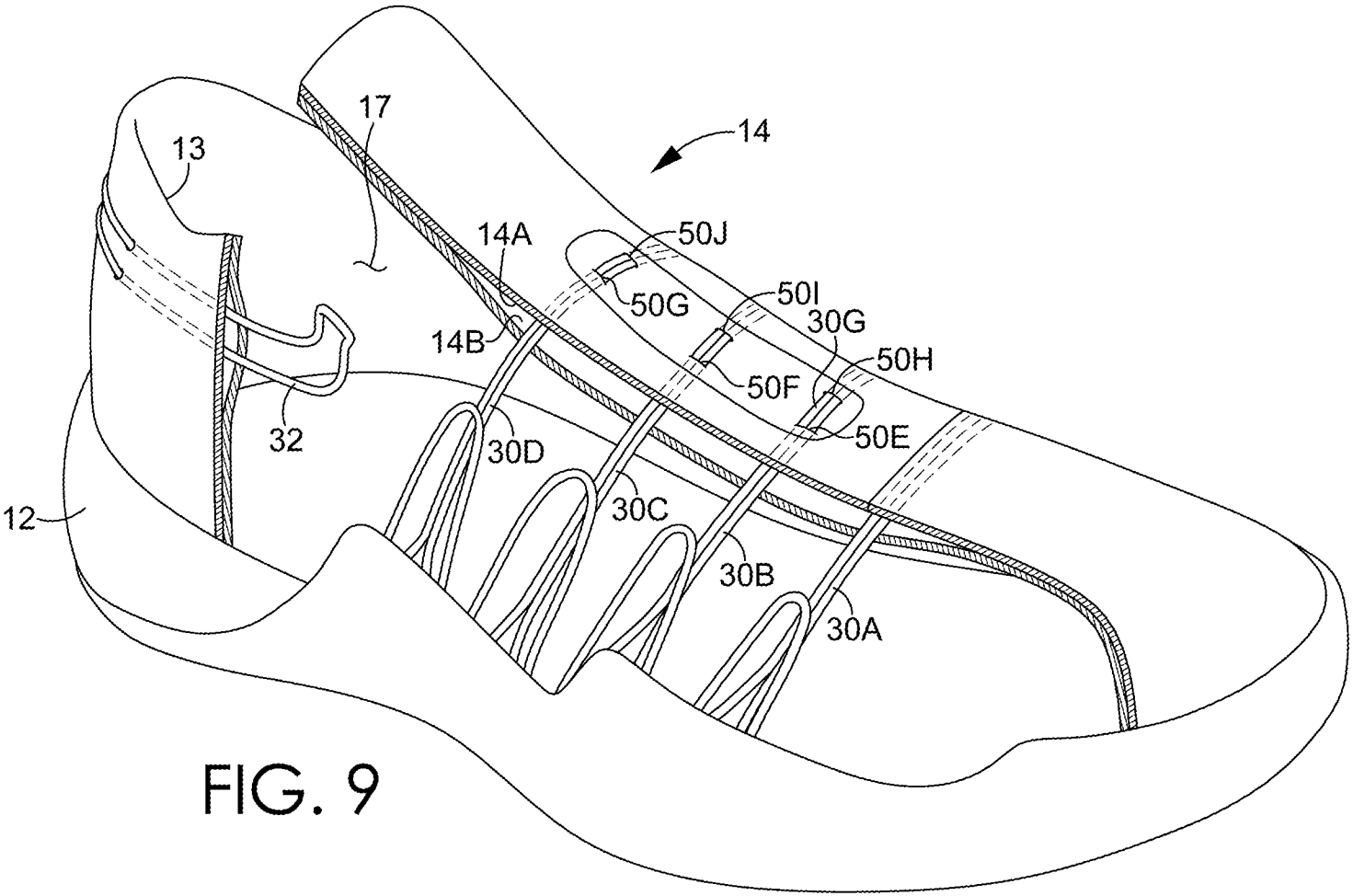
FIG. 9 depicts the footwear article of FIG. 5 with a portion of the upper cutaway in accordance with an aspect hereof.

Referring now to FIGS. 5-9, the footwear 10 is illustrated together with various tensile strands, which are combined with the upper 14. The tensile strands depicted in FIGS. 5-9 are consistent with the tensile strands depicted in FIGS. 1-4. In this respect, the tensile strands in FIGS. 5-9 also provide the partial enclosure and fit-adjusting features described above with respect to FIGS. 1-4. That is, the tensile strands depicted in FIGS. 5-9 can be adjusted to affect a fit of the footwear and to apply pressure, tension, and compression to various portions of the footwear. FIGS. 5-9 illustratively depict one manner in which the tensile strands might be integrated with the upper 14. While FIGS. 5-7 provide different perspective views of the footwear 10, FIG. 8 depicts a cross-sectional view of the footwear 10 taken along cut line 8-8 in FIG. 5, and FIG. 9 depicts a cut-away view in which a portion of the lateral side of the upper 14 has been removed for illustrative purposes.

As depicted in FIGS. 8 and 9, the upper portion 14 and the sole 12 at least partially enclose a foot receiving space 17. Based on the orientation of the footwear 10 in FIGS. 8 and 9, the sole 12 generally forms an inferior portion of the foot-receiving space 17, and the upper 14 generally forms at least part of the medial and lateral sides and superior portion of the foot-receiving space 17. In addition, the upper includes an outer layer 14A and an inner layer 14B. The outer layer 14A and the inner layer 14B may include various types of knitted, woven, or non-woven upper materials. The materials may include textiles, polymer sheets, foam layers, leather, synthetic leather, and the like that are coupled together, such as by bonding or stitching. In one aspect, at least portions of the outer layer 14A and inner layer 14B are separated by a space or void, which functions as a channel for one or more tensile strands extending from one portion of the footwear to another portion of the footwear.

As previously described (and depicted in FIG. 5), the tensile strands 26A-D are attached to the footwear 10 in the midfoot region of the lateral side 22. For example, FIG. 8 depicts the tensile strand 26B coupled between the bonding strip 34 and the inward-facing surface 36 of the sole portion 12, and in other aspects, the tensile strands may be coupled directly between the upper 14 (or outer layer 14A) and the inward-facing surface 36. In addition, each of the tensile strands 26A-D includes a loop portion 42A-D that terminates the tensile strand generally opposite to the attachment to the footwear 10. The loop portions 42A-D serve as anchor points for the lace element 15.

In FIG. 6, the tensile strands 28A-D are attached to the footwear 10 in the midfoot region of the lateral side 24. For instance, FIG. 8 depicts the tensile strand 28B coupled between the bonding strip 38 and the inward-facing surface 40 of the sole portion 12, and in other aspects, the tensile strands may be coupled directly between the upper 14 (or outer layer 14A) and the inward-facing surface 40. In addition, each of the tensile strands 28A-D includes a loop portion 44A-D that terminates the tensile strand generally opposite to the attachment to the footwear 10. The loop portions 44A-D serve as anchor points for the tensile strands 30A-D, which extend over to the medial side 24 from the lateral side 22.

In an aspect of the present invention, the tensile strands 30A-D extend from the lateral side 22 over to the medial side 24, generally along the superior portion of the upper. The tensile strands 30A-D may pass from the lateral side to the medial side along various paths that traverse the foot-receiving space 17, such that the tensile strands 30A-D may extend along the outside of the upper, may extend along the inside of the upper, or may be interwoven with the upper. For example, FIGS. 5-9 depict one aspect in which the tensile strands are interwoven with the upper 14. That is, the outer layer 14A may include a series of apertures 50A-N through which the tensile strands 30A-D may be threaded as the tensile strands 30A-D extend from one side of the footwear 10 to the other side of the footwear 10.

The apertures 50A-N depicted in FIGS. 5-9 may include various structures. For instance, the outer layer 14A includes an outward-facing surface 14C that faces away from the foot-receiving space, an inward-facing surface 14D that faces towards the foot-receiving space, and a thickness extending from the outward-facing surface to the inward facing surface. In one aspect the apertures 50A-N extend completely through the thickness of the outer layer 14A. In addition, the inner layer 14B may also include similar apertures. The apertures 50A-N may be reinforced with a grommet, thermoplastic polyurethane (TPU) overlay, or other reinforcing structure.

In FIGS. 5-9, tensile strand 30A is woven through a set of two apertures 50A (lateral side) and 50K (medial side) in the outer layer 14A. That is, as the tensile strand 30A passes from the lateral side 22 to the medial side 24, the tensile strand 30A includes a first elongated portion that is external to the upper 14. The tensile strand 30A transitions through the aperture 50A from the position external to the upper to a position that is between the outer layer 14A and the inner layer 14B. To illustrate this obscured portion of the tensile strand 30A, an elongated segment 30E of the tensile strand 30A (that is between the outer layer 14A and the inner layer 14B) is illustrated in a ghosted view in FIG. 5. The tensile strand 30A continues to extend over to the medial side of the footwear 10 and transitions through the aperture 50K from the position between the outer layer 14A and inner layer 14B to a position external to the upper 14. As previously described, the tensile strand 30A includes a loop portion 48A that interloops with the tensile strand 28A and functions as an anchor point for the lace element 15.

Each of the tensile strands 30B-D is woven through four respective apertures in the outer layer 14A of the upper 14 as each tensile strand extends from the lateral side to the medial side. For instance, as the tensile strand 30B passes from the lateral side 22 to the medial side 24, the tensile strand 30B includes a first elongated portion that is external to the upper 14. The tensile strand 30B transitions through the aperture 50B from the position external to the upper to a position that is between the outer layer 14A and the inner layer 14B. To illustrate this obscured portion of the tensile strand 30B, an elongated segment 30F of the tensile strand 30B (that is between the outer layer 14A and the inner layer 14B) is illustrated in a ghosted view in FIG. 5. In addition, FIG. 8 illustrates a portion 30F of the tensile strand 30B passing through the aperture 50B and into the space between the outer layer 14A and the inner layer 14B. FIG. 9 provides another illustrative view depicting each of the tensile strands 30A-D extending between the outer layer 14A and the inner layer 14B and depicting additional apertures 50E-J. The tensile strand 30B continues to extend across the superior portion of the upper 14 and towards the medial side of the footwear 10 and transitions through the aperture 50E from the position between the outer layer 14A and inner layer 14B to a position external to the upper 14. After transitioning through the aperture 50E, the tensile strand 30B includes a portion 30G that is external to the upper 14. Continuing to move from the lateral side to the medial side, the tensile strand 30B transitions through the aperture 50H from a position external to the layers 14A and 14B to a position between the layers 14A and 14B. Referring again to FIG. 8, a portion 30H of the tensile strand 30B is depicted passing through the aperture 50H and into the space between the outer layer 14A and the inner layer 14B. The tensile strand 30B then transitions through the aperture 50L from the position between the outer layer 14A and inner layer 14B to a position external to the upper 14. As previously described, the tensile strand 30B includes a loop portion 48B that interloops with the tensile strand 28B and functions as an anchor point for the lace element 15. Similarly, the tensile strands 30C and 30D also transition in an interwoven manner through respective apertures of the upper 14 as each strand extends from the lateral side to the medial side.

FIG. 9 also illustrates a dual-layer upper in the heel portion of the footwear 10, and in an aspect of the technology, the tensile strand 32 is interwoven with the dual-layer upper. For example, as depicted in FIGS. 5 and 7 the heel portion of the upper 14 includes a first set of apertures 60A and 60B and a second set of holes 60C and 60D on the lateral side on the footwear 10. In addition, FIG. 6 depicts a third set of holes 60E and 60F and a fourth set of holes 60G and 60H on the medial side of the footwear 10. The tensile strand 32 is threaded in and out of the holes 60A-G as the tensile strand 32 extends from the lateral side to the medial side in the heel region 20. In addition, the tensile strand includes loop portions 42E and 48E on opposing ends thereof that provide anchor points for the lace element 15. As such, an amount of compression applied on the heel portion and towards the foot-receiving space can be affected by applying or releasing tension applied to the lace element 15.

As described with respect to FIGS. 1-4, the tensile strands 30A-D are usable to provide tension, compression, and size adjustment across the superior portion of the footwear 10. That is, each of the strands 30A-D provides a respective anchor point for the lace element 15, and each of the tension strands 30A-D is drawn inward, towards the foot receiving space when tension is applied to the lace element 15. The tension strands 30A-D are slidably threaded through the apertures, such that the tension strands can slide relative to the upper 14 when tension is applied or released to lace element 15. As such, the upper 14 also compresses inward towards the foot-receiving space when the tension is applied.

FIGS. 5-9 depict one configuration for coupling the tension strands 30A-D with the upper 14, but other coupling configurations are contemplated. For example, the tension strands might be interwoven through fewer or more apertures. In other aspects, the tension strands might slidably extend through individual tubular sheaths that are position on a surface of the upper 14 or that are knit into a knitted upper.

Exemplary Tensile-Strand Arrangement without Upper

Figure 10:
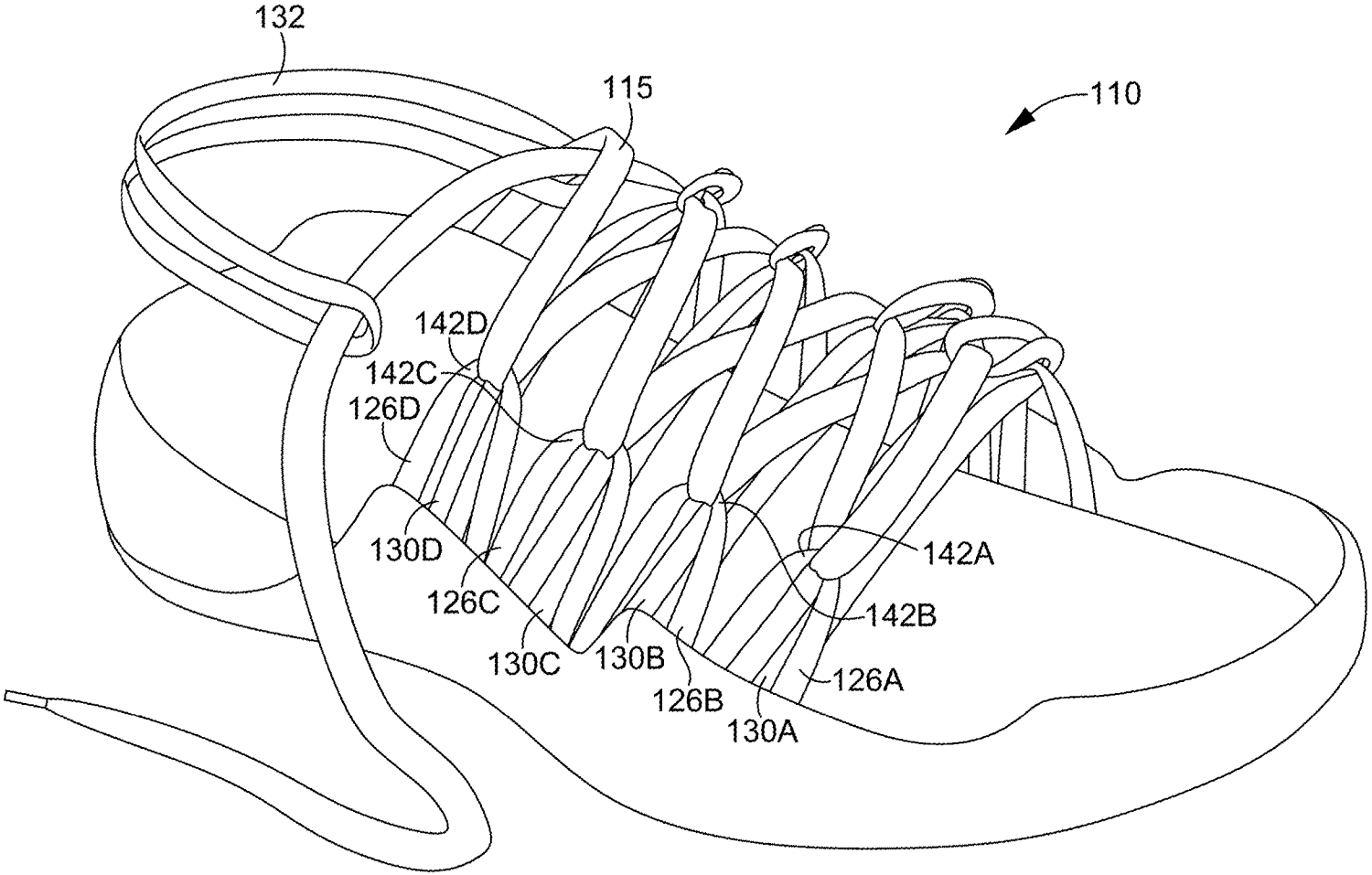
FIG. 10 depicts a front lateral view of an alternative footwear article in accordance with an aspect hereof.
Figure 11:
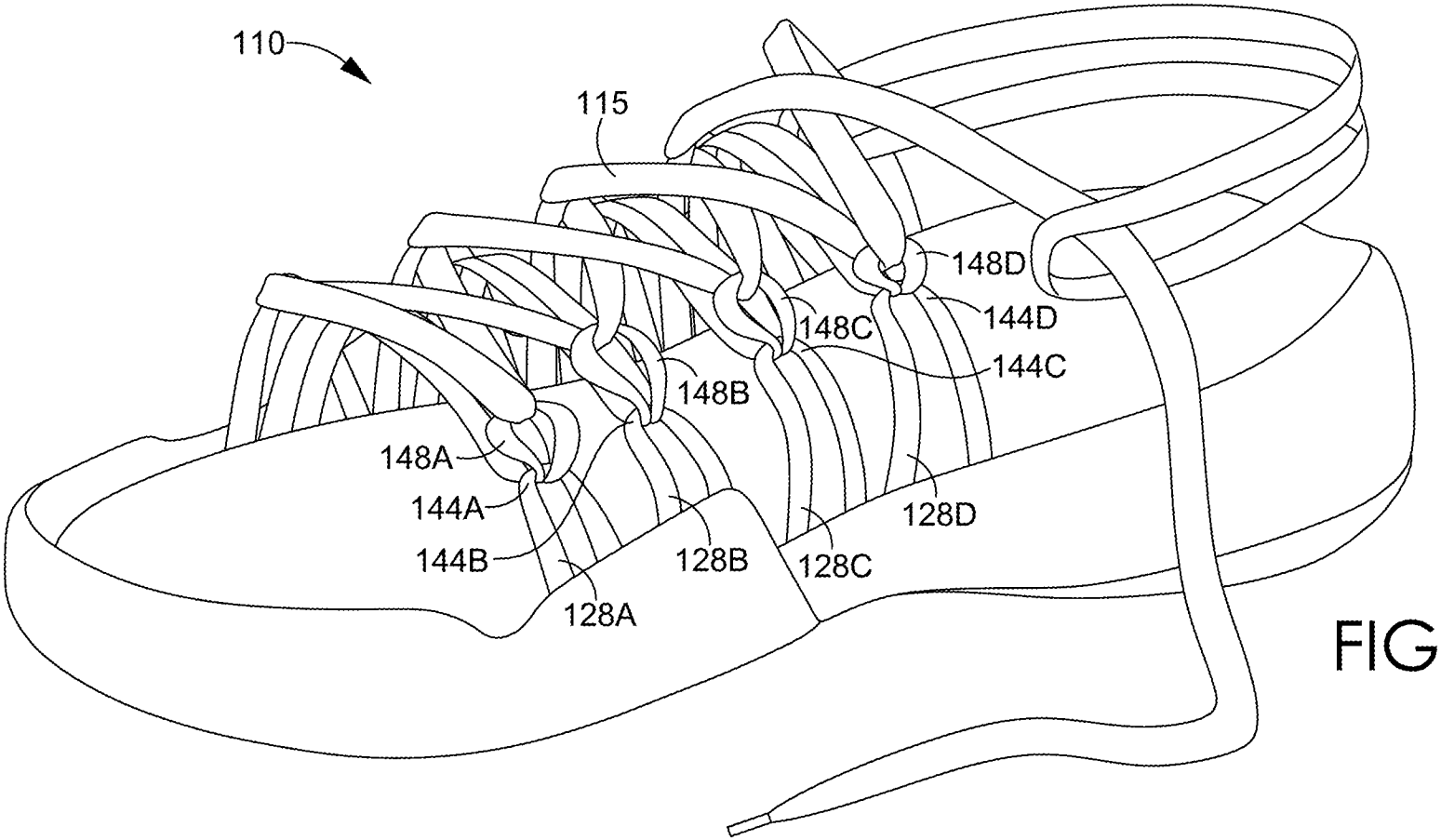
FIG. 11 depicts a front medial view of the footwear article in claim 10 in accordance with an aspect hereof.

Referring now to FIGS. 10 and 11, an exemplary footwear article 110 is depicted that includes a tensile-strand arrangement similar to FIGS. 3 and 4 and that does not include the upper 14 depicted in FIGS. 5-9. FIGS. 10 and 11 depict a sandal-type footwear article 110 in which the tensile strands include a webbing, lace, or strap configuration that forms the upper of the footwear 110. The footwear article 10 includes webbing strands 126A-D, 128A-D, and 130A-D that are arranged similar to tension strands 26A-D, 28A-D, and 30A-D, but a size of the webbing strands has been modified to increase the amount of surface area that each webbing strand covers.

The webbing strands 126A-D, 128A-D, and 130A-D function similarly to the tension strands described with respect to FIGS. 3 and 4. For instance, webbing strands 126A-D provide a set of tethered anchor points 142A-D for the lace element 115. In addition, webbing strands 128A-D provide tethered anchor points 144A-D for the webbing strands 130A-D, which extend from the lateral side of the footwear 110 to the medial side of the footwear 110. The webbing strands 130A-D are interlooped with the tethered anchor points 144A-D to provide another set of anchor points 148A-D for the lacing element 115. In addition, the webbing strand 132 provides additional anchor points for the lacing element 115 and extends around the posterior heel portion. The amount of compression provided by the webbing strands, and the effective size of the foot-receiving space created by the webbing strands, is controlled by the amount of tension applied to the lacing element 115.

Alternative Upper with Tensile Strands

Referring now to FIGS. 12 and 13, an alternative aspect is illustrated of a footwear article 210 that includes tensile strands 230A-D. In the aspect depicted in FIGS. 12 and 13 certain anchor points are provided by eyelets 242A-D and 244A-D, as opposed to the tethered anchor points illustrated in FIGS. 3 and 4. More specifically, eyelets 242A-D provide a first set of anchor points for the lace element 215. In addition, eyelets 244A-D provide another set of anchor points for the tensile strands 230A-D, which extend from the lateral side of the footwear 210 to the medial side of the footwear 210. The webbing strands 230A-D are interlooped with the eyelets 244A-D to provide another set of anchor points 248A-D for the lacing element 215. In addition, the webbing strand 232 provides additional anchor points for the lacing element 215 and extends around the posterior heel portion. The amount of compression provided by the tensile strands 230A-D can be controlled by the amount of tension applied to the lacing element 215.

Other Exemplary Aspects

The technology may include various other aspects, and in describing these other aspects, reference will be made to one or more of the previously described figures for illustrative purposes. One exemplary aspect includes an enclosure system for a footwear article, which includes a lateral side, a medial side, an inferior side, and a superior side, such as the footwear articles depicted in FIGS. 1-13. The enclosure system includes a first strand anchor point (e.g., 42B, 142B, or 242B) on the lateral side of the footwear article, and the first strand anchor point is configured to receive a first strand element (e.g., lace element 15, 115, and 215). In addition, the enclosure system includes a second strand anchor point (e.g., 44B, 144B, and 244B) on the medial side of the footwear article, and the second strand anchor point is configured to receive a second strand element (e.g., 30B, 130B, or 230B). In the exemplary enclosure system, the second strand element (e.g., 30B, 130B, or 230B) extends from the lateral side of the footwear article to the medial side of the footwear by traversing the superior side of the footwear article. In addition, the second strand element interloops with the second strand anchor point to form a third strand anchor point (e.g., 48B, 148B, and 248B) on the medial side. Furthermore, in the enclosure system the first strand element (e.g., 15, 115, and 215) is threaded between the first strand anchor point (e.g., 42B, 142B, or 242B) on the lateral side and the third strand anchor point (e.g., 48B, 148B, and 248B) on the medial side. As previously explained, an amount of tension applied to the second strand element (e.g., 30B, 130B, or 230B) is adjustable by changing an amount of tension applied to the first strand element (e.g., 15, 115, and 215).

Another exemplary aspect of the technology includes another enclosure system for a footwear article, which includes a lateral side, a medial side, an inferior side, and a superior side. The enclosure system includes a sole (e.g., element 12) and a set of tethered lace anchor points coupled to the sole (e.g., 26B and 126B). Each tethered lace anchor point includes an end that is attached to the sole, an elongated portion that extends away from the end and towards the superior side, and a loop portion (e.g., 42B and 142B) configured to interloop with a lace element (e.g., 15 and 115). The tethered lace anchor points might be attached on the lateral side or the medial side. The enclosure further includes a set of tethered tensile-strand anchor points (e.g., 28A and 128A), each tethered tensile-strand anchor point including an end that is attached to the sole and an elongated portion that extends away from the end and towards the superior side. In addition, each tethered tensile-strand anchor point includes a loop portion (e.g., 44B and 144B) configured to interloop with a tensile strand (e.g., 30A and 130A). The tethered tensile-strand anchor points are attached on the side opposite to the tethered lace anchor points. For example, if the tethered lace anchor points are attached to the sole on the lateral side, then the tethered tensile-strand anchor points are coupled on the medial side, and vice versa. The enclosure system also includes the tensile strand (e.g., 30B and 130B) coupled to the sole and extending across the superior side of the footwear article, the tensile strand interlooping with a tethered tensile-strand anchor point included in the set of tethered tensile-strand anchor points. The tensile strand includes another loop portion (e.g., 148B) configured to interloop with the lace element. The lace element (e.g., 15 and 115) is threaded through the loop portion of a tethered lace anchor point and threaded through the other loop portion of the tensile strand.

A further aspect of the present technology includes another enclosure system for a footwear article, which includes a lateral side, a medial side, an inferior side, and a superior side. In accordance with this aspect, the enclosure system includes a sole portion (e.g., 12) and an upper portion (e.g., 14) coupled to the sole portion. The sole portion and the upper portion at least partially enclose a foot-receiving space (e.g., 17) in which the upper portion includes an inward-facing surface (e.g., 14D) facing towards the foot-receiving space and an outward-facing surface (e.g., 14C) facing away from the foot receiving space. The enclosure system also includes a first strand anchor point (e.g., 26B or 226B) positioned on a first side of the footwear article and configured to receive a first strand element (e.g., 15 or 215) and a second strand anchor point (e.g., 28B and 228B) positioned on a second side of the footwear article generally opposite to the first side. The second strand anchor point is configured to receive a second strand element (e.g., 30B or 230B). The first strand anchor point may be on the lateral side or the medial side of the footwear article, in which case the second strand anchor point is on the other side. In this aspect of the technology, the second strand element (e.g., 30B or 230B) extends from the first side of the footwear article to the second side of the footwear by traversing the superior side of the footwear article. In addition, the second strand element is threaded between a position external to the outward-facing surface and a position internal to the inward-facing surface (e.g., FIG. 8). Furthermore, the second strand element interloops with the second strand anchor point to form a third strand anchor point (e.g., 48B and 248B) on the second side of the footwear article. In addition, the first strand element is threaded between the first strand anchor point on the first side and the third strand anchor point on the second side. As previously described with respect to the various figures, an amount of tension applied to the second strand element (e.g., 30B and 230B) is adjustable by changing an amount of tension applied to the first strand element (e.g., 15 and 215).

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

The invention claimed is:

1. An enclosure system for a footwear article, which includes a lateral side, a medial side, an inferior side, and a superior side, the enclosure system comprising:

a first strand element and a second strand element;

a first strand anchor point on the lateral side of the footwear article, the first strand anchor point threadably receiving the first strand element;

a second strand anchor point on the medial side of the footwear article, article, wherein the second strand element extends from the lateral side of the footwear article, across the superior side of the footwear article, and interloops with the second strand anchor point on the medial side of the footwear article; and a third strand anchor point coupled to the second strand element, which is interlooped with the second strand anchor point, and positioned on the medial side of the footwear article, wherein the first strand element threads between the first strand anchor point on the lateral side and the third strand anchor point on the medial side, and wherein an amount of tension applied to the second strand element is adjustable by changing an amount of tension applied to the first strand element.

2. The enclosure system of claim 1, wherein the first strand anchor point includes a tethered anchor point comprising a lateral-side tension strand coupled to the lateral side of the footwear, and wherein the lateral-side tension strand includes a loop portion that interloops with the first strand element.

3. The enclosure system of claim 1, wherein the first strand anchor point includes a shoelace eyelet constructed into an upper portion of the footwear article.

4. The enclosure system of claim 1, wherein the second strand anchor point includes a tethered anchor point comprising a medial-side tension strand coupled to the medial side of the footwear, and wherein the medial-side tension strand includes a loop portion that interloops with the second strand element.

5. The enclosure system of claim 1, wherein the second strand anchor point includes a shoelace eyelet constructed into an upper portion of the footwear article.

6. The enclosure system of claim 1 further comprising, an upper including a first aperture on the lateral side of the footwear article and a second aperture on the medial side of the footwear article, and wherein the second strand element extends through the first aperture and the second aperture when extending from the lateral side of the footwear article to the medial side of the footwear by traversing the superior side of the footwear.

7. The enclosure system of claim 1 further comprising, a third strand element extending from the lateral side to the medial side and around a posterior side of a heel portion of the footwear article, wherein the third strand element includes another lateral-side strand anchor point and another medial-side anchor point, and wherein the first strand element is threaded through the other lateral-side anchor point and the other medial-side anchor point.

8. An enclosure system for a footwear article, which includes a lateral side, a medial side, an inferior side, and a superior side, the enclosure system comprising:

a sole;

a lace element;

a tensile strand coupled to the sole, which interloops with the lace element;

a set of tethered lace anchor points coupled to the sole, each tethered lace anchor point including an end that is attached to the sole, an elongated portion that extends away from the end and towards the superior side, wherein the lace element threads through a loop portion of a tethered anchor point; and a set of tethered tensile-strand anchor points coupled to the sole, each tethered tensile-strand anchor point including an end that is attached to the sole, an elongated portion that extends away from the end and towards the superior side, and a loop portion interlooped with the tensile strand, wherein the tensile strand extends across the superior side of the footwear article and interloops with a tethered tensile-strand anchor point included in the set of tethered tensile-strand anchor points.

9. The enclosure system of claim 8, wherein each tethered lace anchor point and the tensile strand are attached to the sole along the lateral side of the sole, and wherein each tethered tensile-strand anchor point is attached to the sole along the medial side of the sole.

10. The enclosure system of claim 8, wherein each tethered lace anchor point and the tensile strand are attached to the sole along the medial side of the sole, and wherein each tethered tensile-strand anchor point is attached to the sole along the lateral side of the sole.

11. The enclosure system of claim 8 further comprising, another tensile-strand element extending from the lateral side to the medial side and around a posterior side of a heel portion of the footwear article, wherein the third strand element includes a lateral-side, lace-element anchor point and a medial-side, lace-element anchor point, and wherein the lace clement is threaded through the lateral-side, lace-element anchor point and the medial-side, lace-element anchor point.

12. The enclosure system of claim 8 further comprising, an upper coupled to the sole and at least partially enclosing a foot-receiving space, the upper including an inward-facing surface facing towards the foot-receiving space and an outward-facing surface facing away from the foot-receiving space, the upper comprising a thickness between the inward-facing surface and the outward-facing surface.

13. The enclosure system of claim 12, wherein the set of tethered lace anchor points, the set of tethered tensile-strand anchor points, and the tensile strand are external to the outward-facing surface and outside of the foot-receiving space.

14. The enclosure system of claim 13, wherein the upper includes a set of apertures extending through the thickness, and wherein the tensile strand is threaded through the set of apertures to extend along both the inward-facing surface and the outward-facing surface as the tensile strand extends across the superior side.

15. An enclosure system for a footwear article, which includes a lateral side, a medial side, an inferior side, and a superior side, the enclosure system comprising:

a sole portion;

an upper portion coupled to the sole portion, the sole portion and the upper portion at least partially enclosing a foot-receiving space, the upper portion including an inward-facing surface facing towards the foot-receiving space and an outward-facing surface facing away from the foot-receiving space;

a first strand element and a second strand element;

a first strand anchor point positioned on a first side of the footwear article and threadably receiving the first strand element;

a second strand anchor point positioned on a second side of the footwear article generally opposite to the first side, wherein the second strand element extends from the first side of the footwear article, across the superior side of the footwear article, threads between a position external to the outward-facing surface and a position internal to the inward-facing surface, and interloops with the second strand anchor point on the second side of the footwear article; and a third strand anchor point coupled to the second strand element, which is interlooped with the second strand anchor point, and positioned on the second side of the footwear article, wherein the first strand element threads between the first strand anchor point on the first side and the third strand anchor point on the second side, and wherein an amount of tension applied to the second strand element is adjustable by changing an amount of tension applied to the first strand element.

16. The enclosure system of claim 15, wherein the first strand anchor point includes a shoelace eyelet constructed into the upper portion and providing a channel extending from the outward-facing surface to the inward-facing surface.

17. The enclosure system of claim 15, wherein the second strand anchor point includes a shoelace eyelet constructed into the upper portion and providing a channel extending from the outward-facing surface to the inward-facing surface.

18. The enclosure system of claim 15, wherein the first strand anchor point is a tethered anchor point extending external to the outward-facing surface and the foot-receiving space, and wherein the second strand anchor point is a tethered anchor point extending external to the outward-facing surface and the foot-receiving space.

19. The enclosure system of claim 15, wherein the upper portion includes an outer layer and an inner layer, the outer layer including the outward-facing surface and the inward-facing surface.

20. The enclosure system of claim 19, wherein the second strand element passes between the outer layer and the inner layer when the second strand element is threaded to the position internal to the inward-facing surface.

* * * * *